US007121354B2

(12) United States Patent
Munson, Jr.

(10) Patent No.: US 7,121,354 B2
(45) Date of Patent: Oct. 17, 2006

(54) FIRE EXTINGUISHING DEVICE AND METHOD

(75) Inventor: David Murray Munson, Jr., Dallas, TX (US)

(73) Assignee: FOI Group, LLC, Dallas, TX (US)

( * ) Notice: Subject to any disclaimer, the term of this patent is extended or adjusted under 35 U.S.C. 154(b) by 0 days.

(21) Appl. No.: 10/992,053

(22) Filed: Nov. 18, 2004

(65) Prior Publication Data

US 2005/0139367 A1 Jun. 30, 2005

(51) Int. Cl.
*A62C 3/00* (2006.01)
*A62C 13/00* (2006.01)

(52) U.S. Cl. ..... 169/47; 169/30; 169/36; 169/85; 169/28; 169/58

(58) Field of Classification Search ..... 169/6–8, 169/30, 36, 85, 28, 46, 58, 9; 206/219–222
See application file for complete search history.

(56) References Cited

U.S. PATENT DOCUMENTS 1,932,291 A * 10/1933 Prefontaine ..... 169/36
4,709,763 A * 12/1987 Jessick ..... 169/26
4,938,293 A * 7/1990 Warren et al. ..... 169/28
5,291,952 A * 3/1994 Arend ..... 169/71
5,449,041 A * 9/1995 Galbraith ..... 169/11
5,582,254 A * 12/1996 Pistek ..... 169/73
6,769,492 B1 * 8/2004 Bauer et al. ..... 169/30
2003/0168225 A1 9/2003 Denne et al.

FOREIGN PATENT DOCUMENTS

DE 297 00 335-U 1 9/1997
EP 0 711 578 A2 5/1996
FR 2 652 269 A1 3/1991

* cited by examiner

*Primary Examiner*—David A. Scherbel
*Assistant Examiner*—Seth Barney
(74) *Attorney, Agent, or Firm*—Tucker Ellis & West LLP

(57) ABSTRACT

A fire extinguishing device and associated methods. The device is adapted to be positioned in proximity to a fire and operable in response to heat output by the fire. The device includes a first reservoir, containing a fluid, adapted to receive the heat from the fire and thereby exert a pressure and a second reservoir, communicating with the first reservoir, containing a fire fighting material. The device further includes a pressure-sensitive membrane, forming a pressure-sensitive barrier between the first reservoir and the second reservoir, adapted to rupture upon a predetermined pressure being attained in the first reservoir and thereby releasing a steam into the second reservoir. The steam expels the fire fighting material onto the fire. Additionally disclosed are methods for using the device to control and extinguish fires.

17 Claims, 2 Drawing Sheets

FIRE EXTINGUISHING DEVICE AND METHOD

BACKGROUND OF THE INVENTION

The present invention relates to controlling and extinguishing fires, and more particularly the present invention relates to a fire extinguishing device and associated methods.

Fire is a persistent force of nature that causes significant property damage and loss of life. Three components cooperate to drive the chemical combustion reaction that produces fire: extreme heat, a gas (such as oxygen), and a combustible matter (such as a fuel). Using wood as an example of a combustible matter, a fire may result according to the following sequence. First, the wood is heated to a high temperature by any means, such as energy in the form of focused light, energy in the form of friction, or energy in the form of an already burning matter. Next, as the temperature nears about 500 degrees Fahrenheit (the ignition temperature), the cellulose component of the wood begins to decompose. This decomposition causes gases to be released, which gases rise and form the flame of the fire. The heat of the emitted gases provides sufficient heat to maintain the wood at its ignition temperature, thereby perpetuating the fire, assuming a sufficient supply of fuel and oxygen.

Current approaches to controlling and extinguishing fires focus on one or more of the constituents of fire. The current approaches include smothering the fire (to remove the oxygen), cooling the fire (to remove the heat), and starving the fire (to remove the combustible matter).

Existing methods of controlling fires suffer from limited effectiveness. While the use of water to fight fires is one of the oldest methods, it has numerous shortcomings. These negative effects include steam burns, water damage, electrocution, etc. Other methods of fighting fires have evolved and include water chemical foam mixtures, inert gas, and various fire fighting powders that undergo an exothermic reaction to absorb large quantities of heat to quickly extinguish a fire. The water foam spray is gaining popularity as it controls fire better than water. Foam mixtures are used especially to fight flammable liquid and vehicle fires. However, the use of foam is limited by the difficulty of projecting it over a distance. This limitation forces a fire fighter to be physically close to the fire, thereby endangering the life of the fire fighter. Exothermic powders are excellent fire control agents and are widely sold and available in many forms including pressurized fire extinguishers used in homes and businesses. The strength of these powders comes from the very large amount of heat absorbed as the powder undergoes an endothermic chemical reaction. One pound of powder will absorb the heat energy of approximately 100 pounds of water. In order to work effectively, these compounds must be in a fine powder, but because of this most delivery methods can dispense powder just over twenty feet. Many efforts have been made to more effectively deliver these effective fire fighting powders into large fires; however, at the current time, they cannot be effectively used because of the inability to deliver them from a safe distance. When they can be used, such as small fires, they are the most effective method of extinguishing fire. Currently, large fires frequently occur that cannot be extinguished with current technology and sometimes cannot be controlled until they have caused enormous loss of property and life. Thus, there exists a need for an improved device for controlling and extinguishing these currently uncontrollable fires preferably by using these highly effective fire fighting powders.

SUMMARY OF THE INVENTION

Disclosed herein, according to an exemplary embodiment of the present invention, is a fire extinguishing device and associated methods. The device is adapted to be positioned in proximity to a fire and operable in response to heat output by the fire. The device includes a first reservoir, containing a fluid, adapted to receive the heat from the fire and thereby exert a pressure and a second reservoir, communicating with the first reservoir, containing a fire fighting material. The device further includes a pressure-sensitive membrane, forming a pressure-sensitive barrier between the first reservoir and the second reservoir, adapted to rupture upon a predetermined pressure being attained in the first reservoir and thereby releasing a steam into the second reservoir. The steam expels the fire fighting material onto the fire.

In accordance with one aspect of the present invention, the device comprises a housing including the first reservoir, the second reservoir, and the pressure-sensitive membrane, thereby providing a unitary construction. The housing is constructed from materials resistant to high temperatures for a sufficiently long duration to allow activation of the device.

In accordance with another aspect of the present invention, the fluid is water, while the fire fighting material is dry chemical foam, dry chemical powder, sodium bicarbonate, potassium bicarbonate, purple-K, monoammonium phosphate, or halon.

In accordance with yet another aspect of the present invention, the second reservoir is a conical frustum member including a reduced diameter section and an enlarged diameter section. The first reservoir is arranged adjacent to the reduced diameter section of the second reservoir. Similarly, the membrane is positioned near the reduced diameter section of the second reservoir. The device further includes a cover arranged near the enlarged diameter section of the second reservoir. The cover secures the fire fighting material within the second reservoir. The conical shape of the second reservoir causes the fire fighting material to be expelled in a wide-sweeping, blanketing fashion.

Further in accordance with the present invention, there is disclosed herein a method for controlling and extinguishing a fire. The method includes placing a fire fighting device in proximity to a fire, heating a liquid housed within a first reservoir of the device, wherein the heating is in response to heat output by the fire, increasing, in response to the heating of the liquid, a level of pressure within the first reservoir, and rupturing a pressure-sensitive membrane in response to the increased pressure within the first reservoir. The method further includes passing steam from the first reservoir, through the pressure-sensitive membrane to a second reservoir that contains a fire fighting material and expelling the fire fighting material from the device onto the fire.

In accordance with another aspect of the present invention, the fire fighting device is placed in proximity to a fire by a least one of at least one of throwing, shooting, rolling, dropping from an aircraft, catapulting, delivering by cannon, delivering by mortar, dropping by parachute, delivering by missile, and delivering by remote controlled glider.

By virtue of the foregoing, there is thus provided a fire extinguishing device and associated methods capable of using highly effective fire fighting powders.

These and other objects and advantages of the present invention will become readily apparent to those skilled in the art from the following description wherein there is shown and described a preferred embodiment of this invention, simply by way of illustration of one of the best modes suited to carry out the invention. As it will be realized, the invention is capable of other different embodiments and its several details are capable of modifications in various obvious aspects all without departing from the spirit of the present invention. Accordingly, the drawings and descriptions will be regarded as illustrative in nature and not as restrictive.

DETAILED DESCRIPTION OF EXAMPLE EMBODIMENTS OF THE INVENTION

Figure 1:
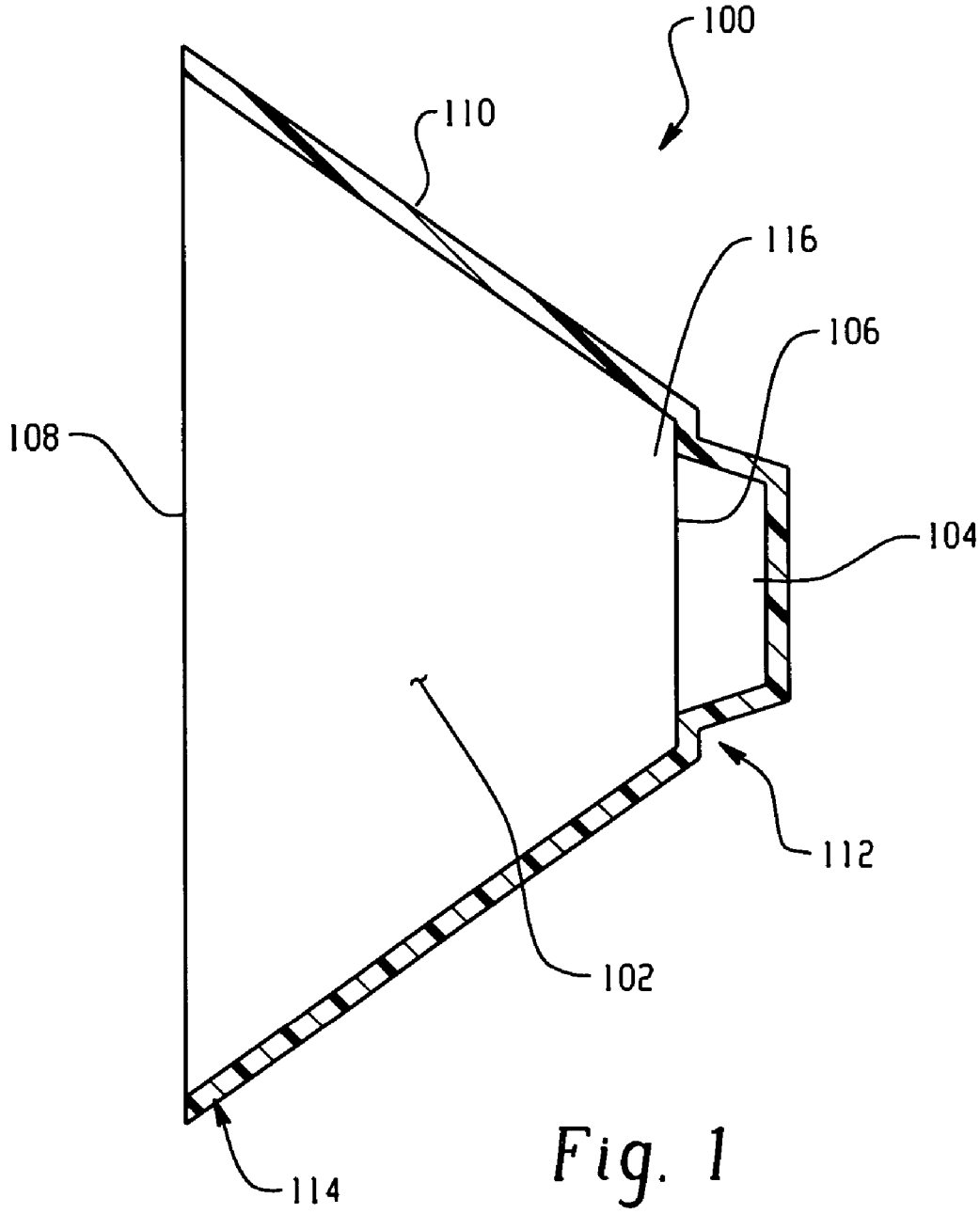
FIG. 1 is a cross-sectional view of an exemplary fire extinguishing device, according to the present invention.

With reference to FIG. 1, illustrated is an exemplary fire extinguishing device 100. As will be more fully explained below, the device 100 is suitably adapted to release a pressurized stream of a fire fighting material onto a fire, thereby controlling and extinguishing the fire. The device 100 generally includes as a unitary construction, a materials reservoir 102, a fluid reservoir 104, a pressure-sensitive membrane 106 and a cover 108, all secured by a housing 110. It is to be understood that the device 100 suitably includes some of these components, all of these components, additional components, or a mixture thereof. Additionally, the components need not be present as a unitary construction and alternatively are suitably provided as a number of separately manufactured components.

The materials reservoir 102 is suitably adapted to provide a receptacle for a fire fighting material. Such fire fighting material is suitably one or more of the following nonexclusive list: dry chemical foam, dry chemical powder, sodium bicarbonate, potassium bicarbonate, purple-K, mono ammonium phosphate, halon 1211, etc. According to a preferred embodiment, purple-K or monoammonium phosphate is used as the fire fighting material. However, it is to be appreciated that any suitable fire fighting material as known in the art is suitably used with the fire extinguishing device 100. As depicted, the materials reservoir 102 is suitably provided as a conical frustum member characterized by a reduced diameter section 112 and an enlarged diameter section 114, the significance of both of which will be described more fully below.

The fluid reservoir 104 is arranged in the device 100 adjacent to the reduced diameter section 112 of the materials reservoir 102. The fluid reservoir 104 is adapted to provide a receptacle for a fluid, such as water. The fluid reservoir 104 is suitably provided as any shape and includes at least one opening 116. According to a preferred embodiment, the fluid reservoir 104 includes one opening 116 that is in fluidic communication with the materials reservoir 102.

The membrane 106 is arranged in the device 100 so as to provide a pressure-sensitive barrier between the fluid reservoir 104 and the materials reservoir 102. In an example embodiment, the membrane 106 is positioned near the reduced diameter section of the materials reservoir 102. The membrane 106 is any suitable pressure-sensitive membrane known in the art and adapted to provide certain properties, as described below.

The cover 108 is arranged in the device 100 near or at the enlarged diameter section 114 of the materials reservoir 102. The cover 108 is suitably adapted to provide a barrier between the interior of the materials reservoir 102 and the environment exterior to the interior of the materials reservoir 102. This barrier secures the fire fighting material within the materials reservoir 102 and prevents spillage or leakage of the same.

The operation of the fire extinguishing device 100 will now be more fully explained. The device 100 is adapted to be positioned within a fire and to control and extinguish the same. The device can be thrown, shot, rolled, dropped from an aircraft, etc. Into the fire. Once the device 100 is in the fire, the heat produced by the fire will cause the temperature of the fluid (e.g., water) within the fluid reservoir 104 to rise. As the temperature of the fluid rises, the pressure within the fluid reservoir 104 will also rise, which pressure will begin to act on the membrane 106. When the pressure threshold of the membrane 106 is reached, the pressure within the fluid reservoir 104 will cause the membrane 106 to rupture. As the membrane 106 ruptures, the pressure within the fluid reservoir 104 drops, thereby catalyzing the rapid conversion of the fluid into steam. The steam then projects out of the fluid reservoir 104 at a high velocity and acts on the fire fighting material in the materials reservoir 102. The action of the steam causes the fire fighting material to break through the cover 108 and be forcefully expelled from the device 100. Because of the conical shape of the materials reservoir 102, the fire fighting material is expelled in a wide-sweeping, blanketing fashion. The fire fighting material then acts on the surrounding fire, controlling and extinguishing the same.

It is to be appreciated that a plurality of modifications to the device are contemplated, each of which suitably increases the effectiveness of the device 100 for controlling and extinguishing a plurality of types of fires. For example, a number of different sizes of the fluid reservoir 104 are contemplated. The size of the fluid reservoir 104 is proportional to the force produced by the steam effluence and the duration of the effluence. Accordingly, the device 100 is suitably designed with a large fluid reservoir 104 for combating large fires or with a smaller fluid reservoir 104 for smaller fires, such as simple household fires.

Additionally, as previously discussed, the membrane 106 is pressure-sensitive. However, the membrane 106 may be designed to be triggered by temperature or by remote control. Such sensitivity of the membrane 106 is also related to the force produced by the steam effluence. Accordingly, the sensitivity of the membrane 106 is a consideration when designing the device 100, depending on the intended application of the device 100.

As discussed above, the device 100 is positioned to control and extinguish a fire in a plurality of ways. According to one embodiment, the device 100 is fitted with a means for elevating the temperature of the fluid reservoir 104, thereby enabling the device 100 to be farther from the fire or to be used against a low temperature fire when expelling the fire fighting material. According to another embodiment, a user of the device 100 causes the device to be positioned within or near the fire. The device 100 is suitably adapted to be positioned within the heart of the fire, thereby maximizing the device's 100 fire controlling and extinguishing capabilities. The device 100 is suitably positioned by being thrown, shot, rolled, dropped from an aircraft, such as a remote controlled aircraft, catapulted, delivered by canon or mortar, dropped by a parachute, delivered by a missile, such as a heat seeking missile, delivered by remote controlled glider, etc. Additionally, the device 100 or a plurality of devices 100 is suitably positioned wholly or partly in the ground, such as in a forest or mounted on buildings so as to combat the future outbreak of fires, such as forest fires.

A plurality of devices 100 are suitably employed at one time to combat a fire. For example, a fire fighter positions a plurality of devices 100 within a fire. According to another example, a plurality of devices 100 are cojoined and positioned within a fire as a unit. The devices 100 are advantageously cojoined in such a fashion so as to maximize the area of fire covered by the discharge of the firefighting material, such as by staggering the arrangement of the devices 100 so that no two devices expel the firefighting material in the same direction. It is to be appreciated that the cojoined plurality of devices 100 example embodiment is suitably adapted for use with any of the delivery devices and methods described above.

Because the device 100 is intended to be placed within or near a fire, the device 100, including the housing 110, is advantageously constructed from materials resistant to high temperatures. Such materials are well-known in the art and provide for resistance to temperatures exceeding 500 degrees Fahrenheit. Additionally, because the device 100 is configured to only operate at high temperatures, the device 100 is safe for use, as such temperatures are unlikely to be survived by persons near the device 100 for a duration sufficiently long to activate the device 100.

Figure 2:
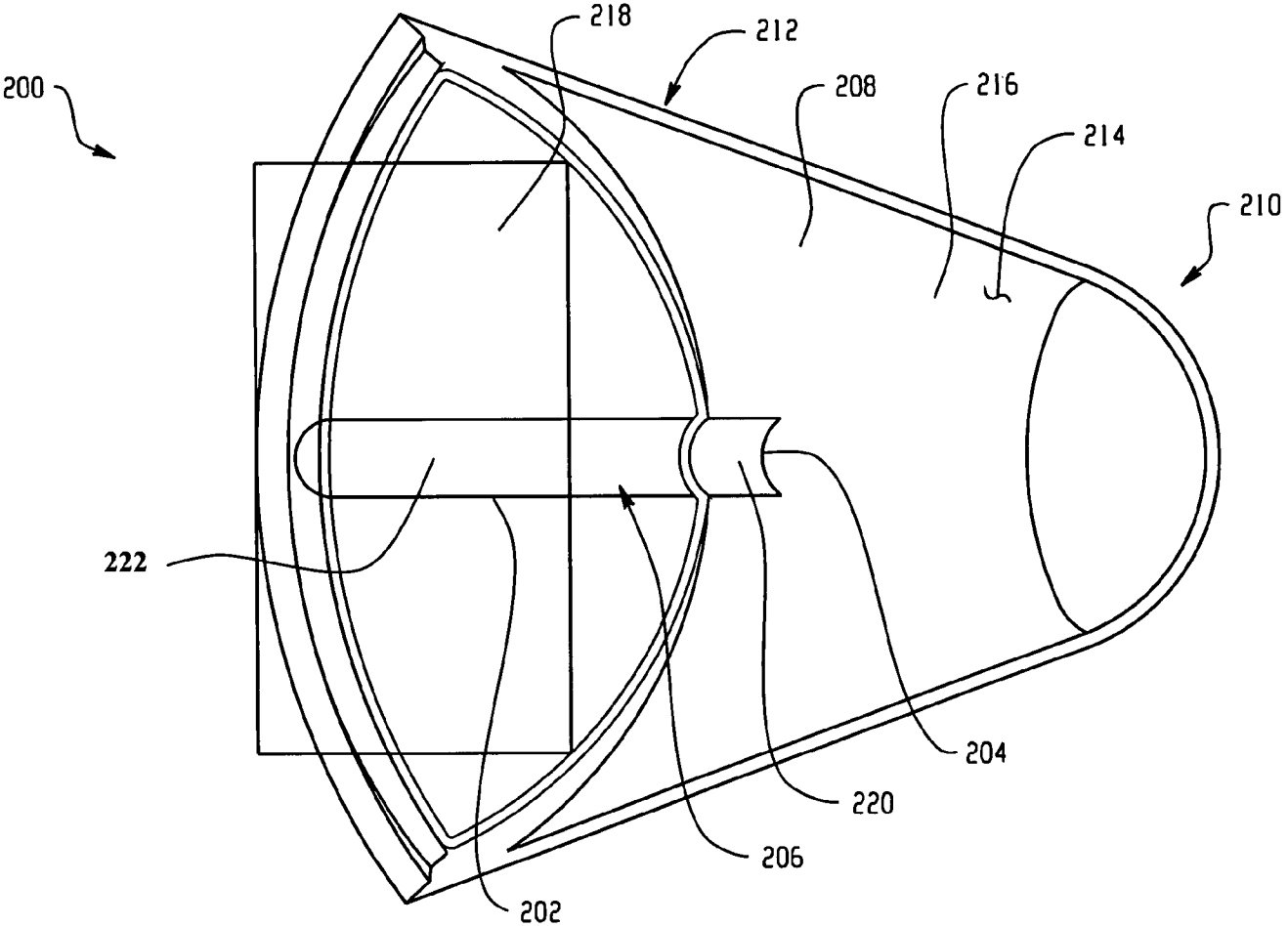
FIG. 2 is a sectional view of an alternative arrangement of a fire extinguishing device.

FIG. 2 shows an alternative arrangement of a fire extinguishing device 200. Device 200 is similarly adapted to release a pressurized stream of a firefighting material onto a fire, thereby controlling and extinguishing the fire. The device 200 generally includes a stubout tube 202, with a shape similar to that of a test tube, including an opening or aperture 204, and forming a first reservoir 206. The first reservoir 206 contains a fluid, such as water 208, and is adapted to receive the heat from the fire and thereby exert a pressure. In a preferred embodiment, a stubout tube 202 costs less than one dollar and in tests holds more than 1,000 pounds per square inch (psi) at about 600 degrees of internal water 208 temperature.

The device 200 also includes a generally conical shaped housing 222 having a reduced diameter section 210 and an enlarged diameter section 212, and forming a second reservoir 214 for containing a firefighting material, such as a powder 216. The conical shaped housing 222 is suitably constructed from materials resistant to high temperatures for a sufficiently long duration to allow activation of the device 200. The conical shape of the housing 222 causes the powder 216 to be expelled in a wide-sweeping, blanketing fashion.

The device 200 further includes a cover or reflector 218. Reflector 218 is arranged at or near the enlarged diameter section 212 of the housing 222 and is adapted to secure the powder 216 within the housing 222. The reflector 218 is additionally adapted to position the stubout tube 202 relative to the housing 222 such that the first and second reservoirs 206, 214 are in fluidic communication via the aperture 204 in the stubout tube 202.

The device 200 still further includes a pressure-sensitive membrane, forming a pressure-sensitive barrier between the first reservoir 206 and the second reservoir 214. In this arrangement 200, the pressure sensitive membrane is in the form of an epoxy plug 220 that serves to seal the water 208 in the first reservoir 206, and that yields, fails, or ruptures first by pressure and later by temperature upon a predetermined, e.g., selected, pressure being reached in the first reservoir 206. Additionally, and in other embodiments, a pressure-sensitive membrane suitably includes any area of a structure or any structure that yields at a pressure below that of the rest of the first reservoir 206. As examples, a pressure sensitive membrane includes, but is not limited to, a cap having a thickness thinner than that of the structure forming the first reservoir 206, an epoxy, serving as described above, and a burst port.

When the barrier yields, pressure within the first reservoir 206 drops causing the fluid contained within to substantially instantaneously convert to a vapor. For example, in the case of water 208 as the working fluid, high pressure steam enters the second reservoir 214 and expels the firefighting material, e.g., powder 214, outward onto the fire as it expands. This action is accomplished by "blowing-out" stubout tube 202 and/or reflector 218. The word "steam" as used herein denotes any fluid including water 208 that is converted from a liquid to a gas or vapor.

Additionally disclosed according to the invention are methods for using the devices 100, 200 to control and extinguish fires. Such methods will be appreciated by an understanding of the discussion above. For example, with respect to the embodiment of FIG. 2, the fire extinguishing device 200 is placed in proximity to a fire by any means described herein. When placed in proximity to a fire, the liquid, e.g., the water 208, housed within the first reservoir 206 of the device 200 is heated in response to heat output by the fire. As the liquid, e.g., the water 208, is heated, the level of pressure within the first reservoir 206 increases. In response to the increased pressure within the first reservoir 206, the pressure-sensitive membrane, e.g., epoxy plug 220, ruptures. When the pressure sensitive membrane ruptures, pressure within the first reservoir 206 drops causing the fluid, e.g., the water 206, contained within the first reservoir 206 to substantially instantaneously convert to a vapor or steam. The steam passes from the first reservoir 206, through the pressure-sensitive membrane, e.g., epoxy plug 220, to the second reservoir 214 that contains the firefighting material, e.g., powder 216, expelling the firefighting material from the device 200 onto the fire, such as by blowing out stubout tube 202 and/or reflector 218. The firefighting material acts on the fire, controlling and extinguishing the same.

Although the preferred embodiments have been described in detail, it should be understood that various changes, substitutions, and alterations can be made therein without departing from the spirit and scope of the invention. It will be appreciated that various changes in the details, materials and arrangements of parts, which have been herein described and illustrated in order to explain the nature of the invention, are made by those skilled in the area within the principle and scope of the invention.

What is claimed is:

1. A fire extinguishing device adapted to be positioned in proximity to a fire and operable in response to heat output by the fire, wherein the device comprises:

a first reservoir, containing a fluid, adapted to receive the heat from the fire and thereby exert a pressure;

a second reservoir, communicating with the first reservoir, containing a firefighting material; and a pressure-sensitive membrane, forming a pressure-sensitive barrier between the first reservoir and the second reservoir, adapted to rupture upon a predetermined pressure being attained in the first reservoir and thereby releasing a steam into the second reservoir, wherein the steam expels the firefighting material onto the fire, wherein the second reservoir is provided as a conical shape member characterized by a reduced diameter section and an enlarged diameter section, and wherein the first reservoir is arranged adjacent to the reduced diameter section of the second reservoir.

2. The device of claim 1, wherein the device includes the first reservoir, the second reservoir, and the pressure-sensitive membrane as a unitary construction secured by a housing.

3. The device of claim 2, wherein the housing is constructed from a heat-resistant material.

4. The device of claim 1, wherein the firefighting material is selected from the group consisting of dry chemical foam, dry chemical powder, sodium bicarbonate, potassium bicarbonate, purple-K, monoammonium phosphate, and halon.

5. The device of claim 1, wherein the membrane is positioned near the reduced diameter section of the second reservoir.

6. The device of claim 1, further comprising a cover arranged near the enlarged diameter section of the second reservoir and adapted to secure the firefighting material within the second reservoir.

7. The device of claim 1, wherein the conical shape of the second reservoir causes the firefighting material to be expelled in a wide-sweeping, blanketing fashion.

8. The device of claim 1, wherein the fluid is water.

9. The device of claim 1, wherein the first reservoir includes at least one opening that is in fluidic communication with the second reservoir.

10. The device of claim 1, wherein the device is adapted to be positioned in proximity to a fire by at least one of throwing, shooting, rolling, dropping from an aircraft, catapulting, delivering by cannon, delivering by mortar, dropping by parachute, delivering by missile, and delivering by remote controlled glider.

11. A method for controlling and extinguishing a fire comprising:

placing a firefighting device in proximity to a fire;

heating a liquid housed within a first reservoir of the device, wherein the heating is in response to heat output by the fire;

increasing, in response to the heating of the liquid, a level of pressure within the first reservoir;

rupturing a pressure-sensitive membrane in response to the increased pressure within the first reservoir;

passing steam from the first reservoir, through the pressure-sensitive membrane to a second reservoir that contains a firefighting material; and expelling the firefighting material from the device onto the fire.

12. The method of claim 11, wherein the firefighting device is placed in proximity to a fire by a least one of at least one of throwing, shooting, rolling, dropping from an aircraft, catapulting, delivering by cannon, delivering by mortar, dropping by parachute, delivering by missile, and delivering by remote controlled glider.

13. The method of claim 11, wherein the liquid housed within the first reservoir of the device is water.

14. The method of claim 11, wherein as the pressure-sensitive membrane ruptures, the pressure level within the first reservoir drops, further comprising catalyzing the rapid conversion of the liquid to steam.

15. The method of claim 11, further comprising breaking through at least one of a cover, a stubout tube, and a reflector with the firefighting material to expel the firefighting material from the device onto the fire.

16. The method of claim 11, wherein the firefighting material is at least one of dry chemical foam, dry chemical powder, sodium bicarbonate, potassium bicarbonate, purple-K, monoammonium phosphate, and halon.

17. The method of claim 11, wherein the device is constructed of a heat-resistant material.

* * * * *